US005393112A

United States Patent [19]

O'Connell

[11] Patent Number: 5,393,112

[45] Date of Patent: Feb. 28, 1995

[54] UNITARY MULTI-TIERED DISPLAY DEVICE WITH AXIS ENCIRCLING ARTICLE RECEIVING PORTIONS

[76] Inventor: Donald L. O'Connell, 114 Wilkins Ave., Port Chester, N.Y. 10573

[21] Appl. No.: 132,702

[22] Filed: Oct. 6, 1993

[51] Int. Cl.[6] ..... A47F 3/14

[52] U.S. Cl. ..... 294/143; 211/14; 211/128; 294/146; 294/161

[58] Field of Search ..... 294/141-144, 294/146, 159-161, 167, 172; 108/92, 94, 101; 206/45, 557, 561, 564; 211/13, 14, 2, 113, 126, 128, 129, 131, 133; 220/4.26, 23.83

[56] References Cited

U.S. PATENT DOCUMENTS

| | | | |
|---|---|---|---|
| 1,928,594 | 9/1933 | Kearney | 294/161 X |
| 1,997,587 | 4/1935 | Kolb | 294/161 |
| 2,837,218 | 6/1958 | Arceo | 211/129 |
| 2,902,174 | 9/1959 | Audsley | 108/101 |
| 3,198,338 | 8/1965 | McCormick | 211/14 |
| 3,224,625 | 12/1965 | Sperl | 294/146 X |
| 3,756,462 | 9/1973 | Cain | 220/23.83 |
| 3,951,079 | 4/1976 | Tolleson | 294/161 X |

*Primary Examiner*—Johnny D. Cherry

*Attorney, Agent, or Firm*—Brooks Haidt Haffner & Delahunty

[57] ABSTRACT

A formed unitary display device includes at least two concentric and stepped arcuate ledges for receiving and holding various fruits, nuts and other articles. The unitary display device also includes a rupturable top planar surface, which prior to rupture serves as an additional display surface. Upon rupturing of the panel, a lip surrounding the ruptured area serves as a support for various containers fitting therewithin.

26 Claims, 4 Drawing Sheets

UNITARY MULTI-TIERED DISPLAY DEVICE WITH AXIS ENCIRCLING ARTICLE RECEIVING PORTIONS

FIELD OF THE INVENTION

The present invention relates to a display device having a series of tiers for holding various comestible articles, including fruit, and decorative items, such as flowers.

BACKGROUND OF THE INVENTION

Support structures for displaying fruits or other comestible articles often require the manufacture and assembly of several parts, involving varying degrees of labor. See, for example, U.S. Pat. No. 4,978,019. Further, great efforts are expended for arranging individual fruits and/or articles into an aesthetically pleasing display. Assembled support structures can be intricate and are not easily altered. In fact, even minor changes to an arrangement can destroy its beauty.

SUMMARY OF THE INVENTION

It is an object of the invention to provide an improved one-piece or unitary display device for holding fruits or other perishable articles or items to be observed by human beings.

A further object of the invention is to provide a display device having portions for receiving and holding fruits or other articles which can be easily modified for displaying various articles, such that the appearance of the arranged portion of the display is not altered by changes to the variable portion.

In accordance with the present invention, an improved display device for holding various fruits, nuts and other articles is disclosed. The formed unitary display includes at least two concentric and stepped arcuate ledges for receiving and holding the articles thereon. The display also includes a rupturable top planar surface, which prior to rupture serves as an additional display surface. Upon rupturing, a lip surrounding the ruptured area serves as a support for various containers which can fit therewithin.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

DESCRIPTION OF THE PREFERRED EMBODIMENTS

Figure 1:
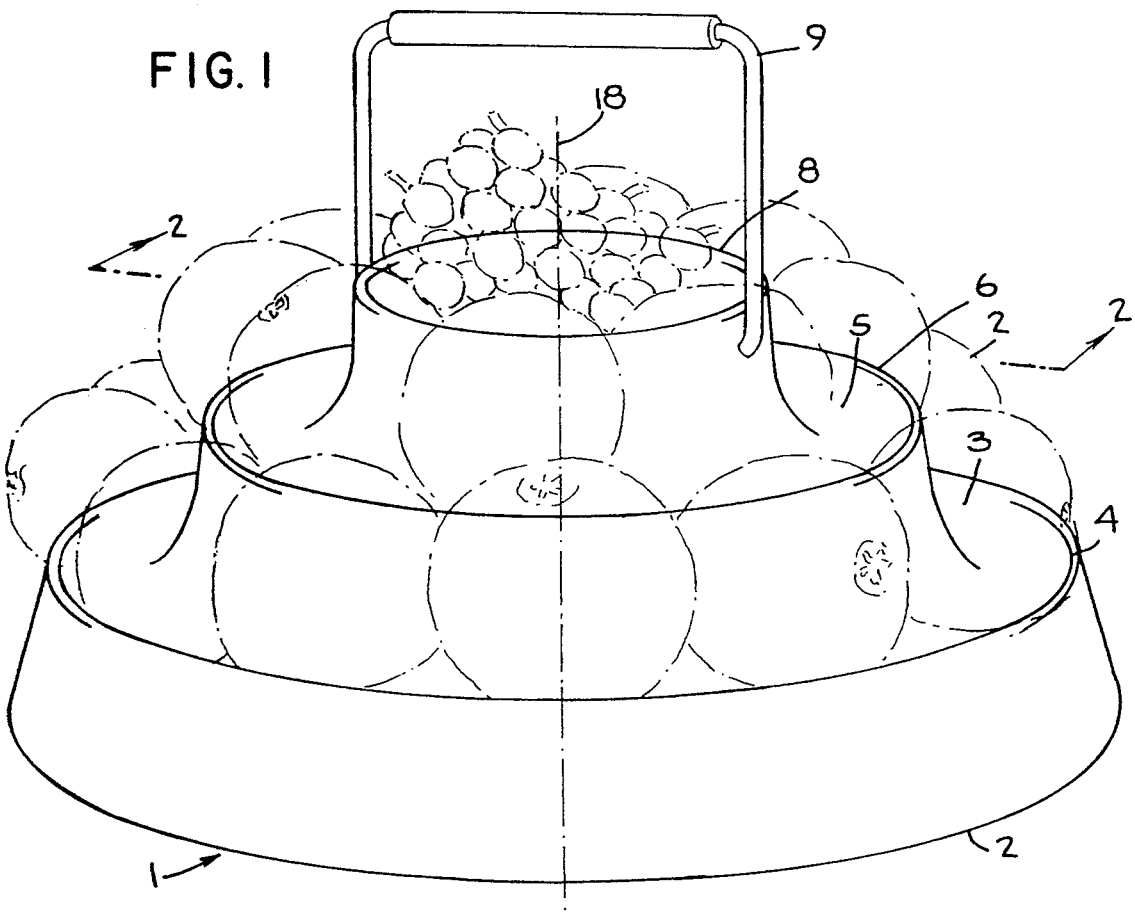
FIG. 1 is a perspective view of a multitier display device in accordance with the present invention With pieces of fruit shown in chain dotted lines.
Figure 2:
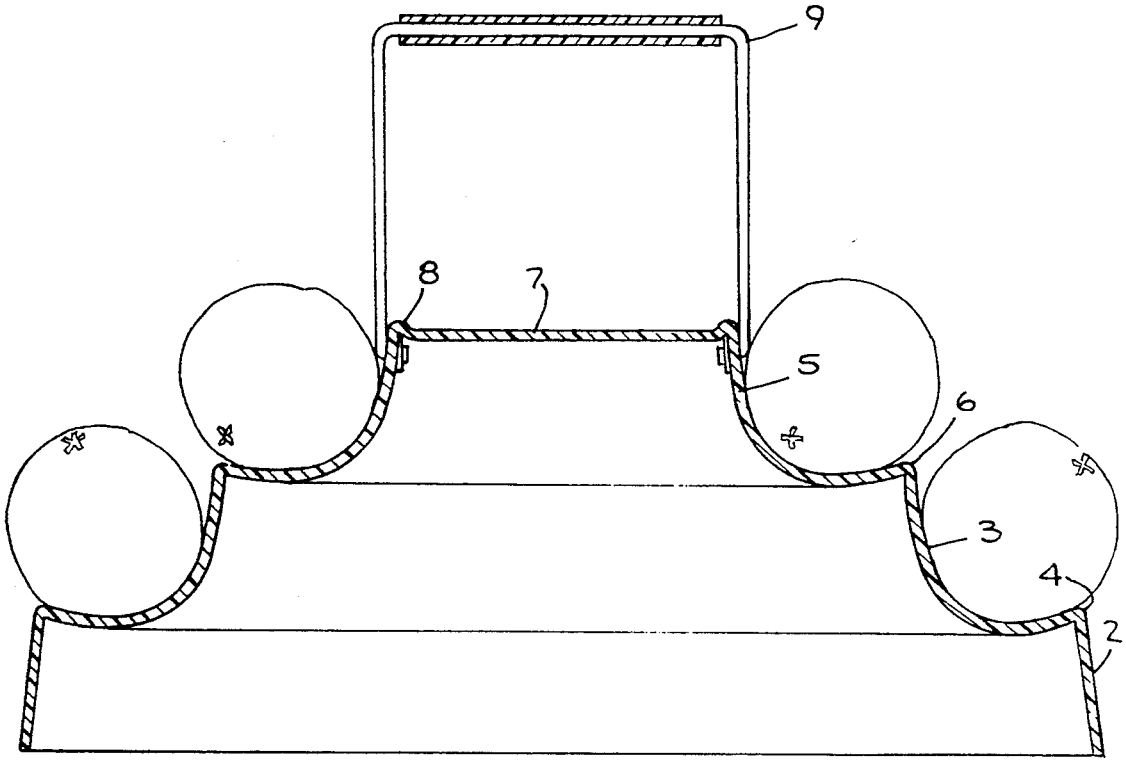
FIG. 2 is a transverse, cross-sectional view of the display device shown in FIG. 1 and is taken along the line 2—2 shown in FIG. 1.

Referring now to FIGS. 1 and 2, there is shown a one-piece or unitary display device of the invention, which is designated generally by the numeral 1. A substantially vertical annular side wall 2 provides a support base for the upper portions of the display device 1 and any articles placed thereon.

Extending upwardly from the side wall 2 are a plurality of stepped support tiers. A lower support tier portion 3 has, in cross-section, a downwardly concave, preferably arcuate, surface or ledge encircling the vertical axis 18 of the display device 1 for receiving comestible articles, such as fruits, having a generally spheroidal shape, as shown in FIGS. 1 and 2. The radially outward end of the concave surface merges with the upper end of the wall 2 to form a raised lip 4 for containing the displayed articles on said lower support tier portion 3. An upper support tier portion 5 also has, in cross-section, a downwardly concave surface or ledge encircling the vertical axis 18 of the display device 1 for receiving similar articles. The radially outward end of the concave surface of tier portion 5 merges with the radially inward, upper end of the surface of the portion 3 to form a raised lip 6 for containing the displayed articles on the upper support tier portion 5.

As shown in the figures, the tier portions are concentric with each tier portion having a diameter smaller than the diameter of the next adjacent tier portion vertically below it. Although only two tier portions 3 and 5 are shown, the number of tier portions can be more than two.

At the top of the display device 1 is a substantially horizontal top panel 7 surrounded by a lip 8 at the upper portion of the upper support tier 5 and above top panel 7 to contain various articles placed thereon. Small fruits, nuts or other articles may be placed on the dish-like top surface of the panel 7 for display or easy access. The panel 7 extends substantially perpendicularly to the axis 18 and is connected at its radially outward edge to the radially inward, uppermost portion of the uppermost tier portion 5.

If desired, a handle 9, engaging display device 1 at the upper portion of the tier portion 5, can be included to provide a simple means to transport the display device 1, even if it is heavily laden with articles. Preferably, handle 9 is detachable and may be attached to said display 1 in a conventional manner, such as by having its free ends enter into holes in the tier portion 5, as shown, so that the handle 9 is pivotable.

The side wall 2, lower 3 and upper 5 tier portions, and top surface 7 are formed in one piece to provide a unitary body. Preferably, the display device is formed by vacuum forming from a sheet of plastic, such as glycol modified polyethylene terephthalate (PETG), polyvinylchloride (PVC) or high density polyethylene (UHMWPE) plastic, having a thickness in the range from about 0.040 to about 0.090 inches.

Figure 3:
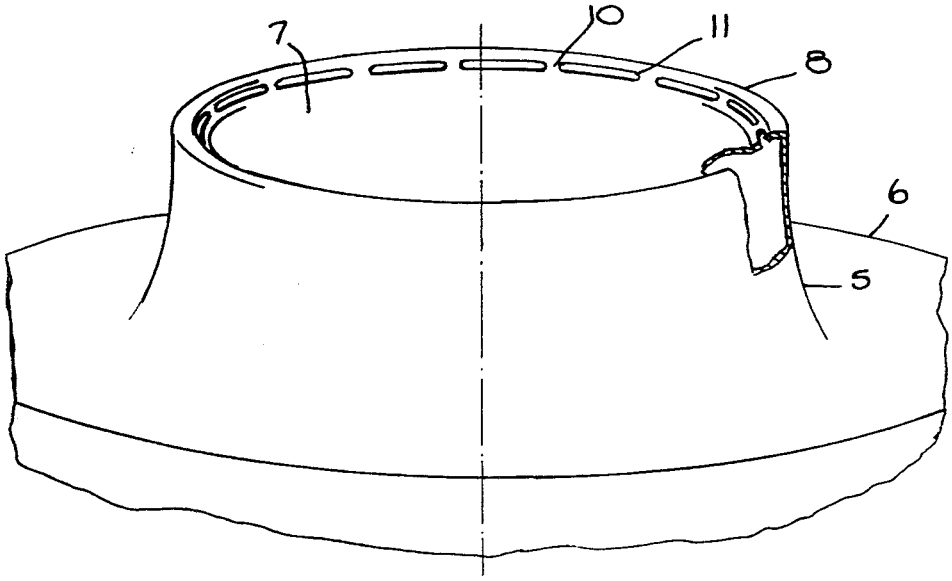
FIG. 3 is an enlarged, fragmentary perspective view, partially in cross-section of the top portion of the display device shown in FIG. 1.

Referring now to FIG. 3, the top portion of the device 1 is shown in greater detail and partially in cross-section. The panel 7 is connected to the lip 8 by an easily rupturable or cutable wall 10. For example, the wall 10 can have a line of weakening comprising a plurality of closely spaced slots 11, for receiving a knife blade, and when the wall 10 is cut, top panel 7 can be removed from the remaining portions of the unitary display device 1. It should be understood that alternative means for separating the panel 7 from the device 1, such as scoring or thinning of the wall 10, can be used to provide the line of weakening.

Figure 4:
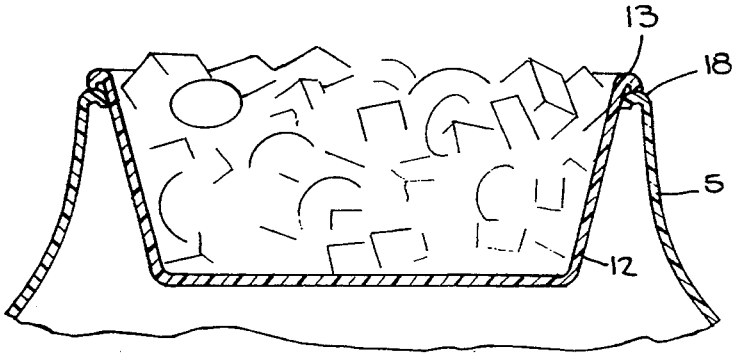
FIG. 4 is a fragmentary, cross-sectional view of the top portion of the display device shown in FIGS. 1–3 modified, in accordance with the present invention, by removing a top panel for receiving and supporting a container.

After removing said panel 7 from the display device 1, the opening to the interior of hollow device 1 which remains can also be used for a variety of display purposes. As shown in FIG. 4 a plastic container 12 containing items, such as pieces of candy or fruit can be placed within the circular opening and supported therein by the lip 8.

As shown in FIG. 4 the container 12 placed within the circular opening at the top of display device 1 preferably has a lip 13 around the upper portion thereof of a diameter greater than the interior diameter of the lip 8 to engage the lip 8 of display device 1, thereby supporting said container 12 within the opening.

Figure 5:
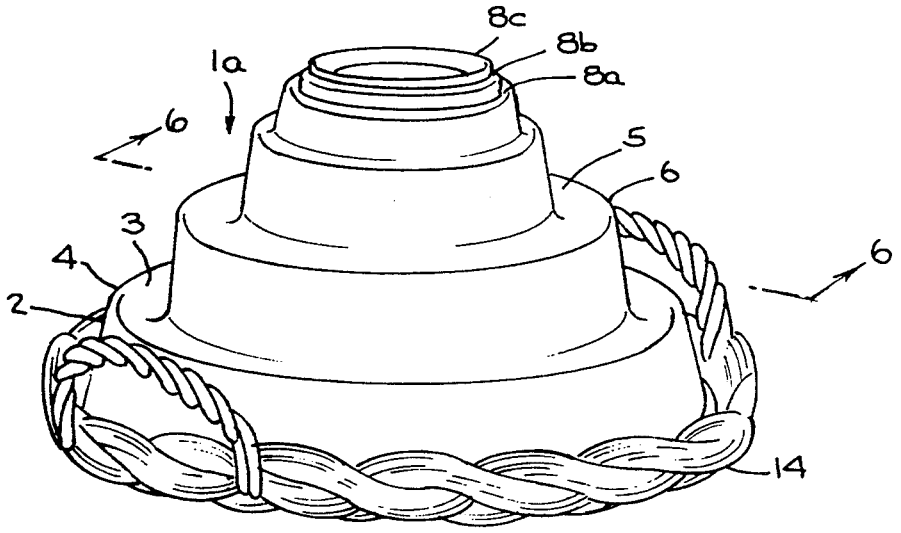
FIG. 5 is a perspective view of an alternative embodiment of the multitier display of the present invention in conjunction with a basket.
Figure 6:
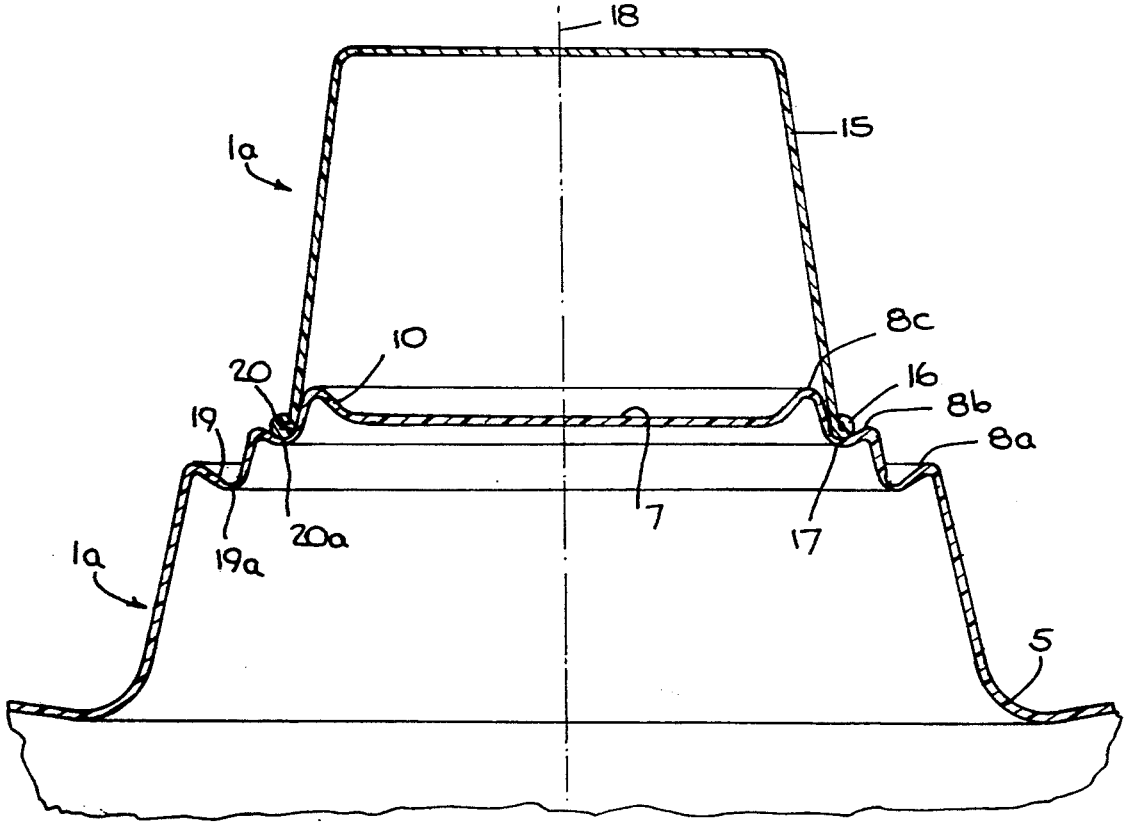
FIG. 6 is an enlarged cross-sectional view of the top portion of the display device shown in FIG. 5 with a cover added and taken along the line 6—6 shown in FIG. 5.
Figure 7:
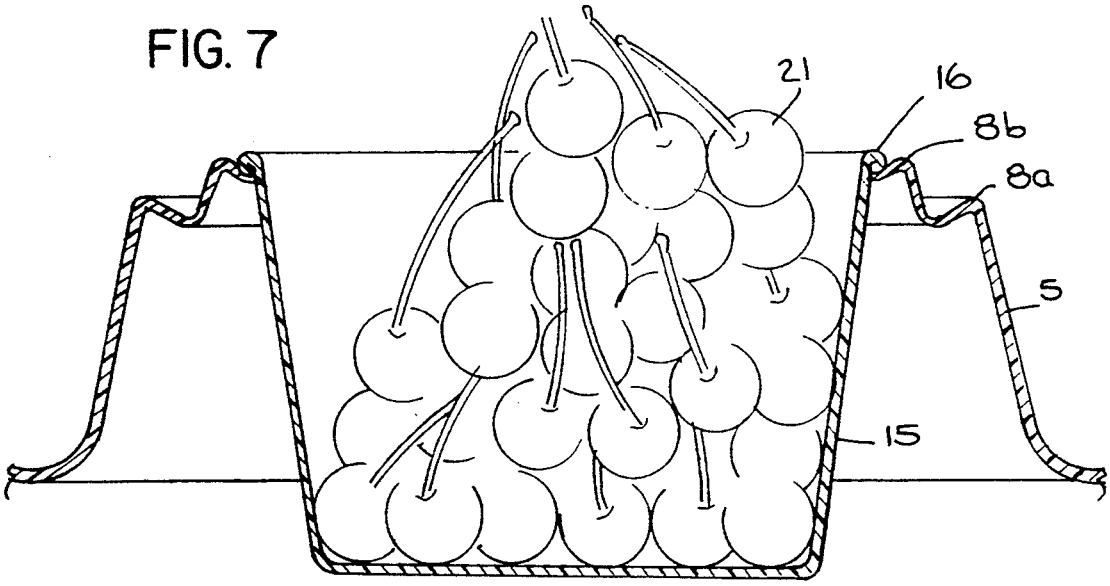
FIGS. 7 and 8 are fragmentary cross-sectional views of the alternate embodiment of FIGS. 5 and 6 showing alternate configurations of the top portion of the alternate form of the display device of the invention after removing the top panel for receiving and supporting containers.
Figure 8:
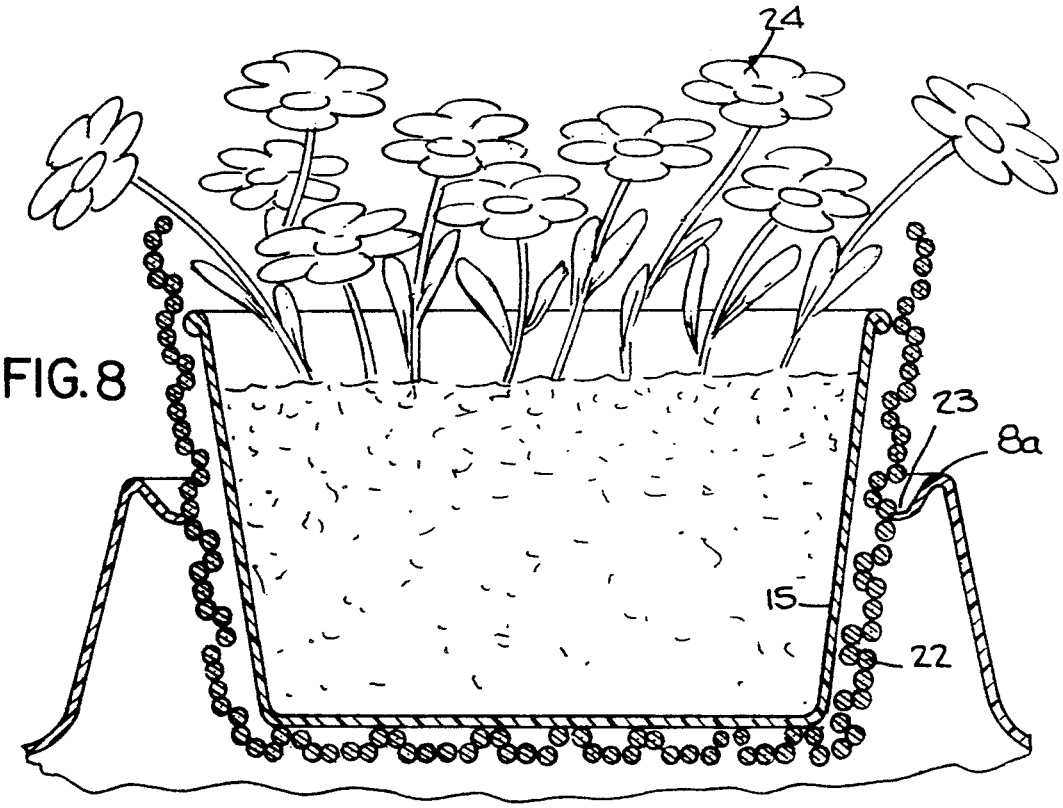

The alternate embodiment of the display device 1*a*, shown in FIGS. 5 and 6, differs from the device 1 only at its top portion and the omission of the handle 9 and permits use of the device 1*a* either with a cover 15, as shown in FIG. 6, or with containers of different sizes or types, as shown in FIGS. 7 and 8.

In the embodiment shown in FIGS. 5 and 6, the top portion is formed with three lips 8*a*, 8*b* and 8*c* of different diameters and which encircle the vertical axis 18 of the device 1*a*. Although the grooves 19 and 20, respectively between the lips 8*a* and 8*b* and the lips 8*b* and 8*c*, can form adequate cutting guides for removing the panel 7 with the lip 8*c* or the panel 7 with the lips 8*c* and 8*b*, the plastic material at the bottom of the grooves 19 and 20 can be made thinner as indicated at 19*a* and 20*a* or can be perforated like the wall 10 to aid in removal of the panel 7 and the lips 8*c* or 8*c* and 8*b*.

Although the handle 9 could be included in the embodiment shown in FIG. 5, FIG. 5 shows a decorative partial basket or tray 14 for carrying the display device 1*a*. A similar basket or tray 14 could be used in place of, or in addition to, the handle 9 for carrying the display device 1 shown in FIGS. 1–3.

As shown in FIG. 6, the display device 1*a* can be used without removing the panel 7 by adding an inverted cup 15, e.g. a plastic cup, having a rim 16 which fits into the groove 20. Alternatively, the rim 16 could fit into the groove 19 if the rim 16 has a larger diameter. The addition of the cup 15 may, for some people, provide a more pleasing appearance for the display device 1*a* and can be externally decorated. Also, if a comestible, such as cheese, is placed on the panel 7, the cup 15 can serve as a temporary cover to protect the comestible from air and insects.

FIG. 7 is similar to FIG. 4 in that it illustrates the use of the device 1*a* with the panel 7 and the lip 8*c* removed by cutting and the insertion of the cup 15 in the remaining opening; the cup 15 being supported at its rim 16 by the lip 8*b*. Of course, if the cup 15 has a larger diameter, the panel 7 and both of the lips 8*c* and 8*b* can be removed by cutting and the rim 16 would rest on the lip 8*a* rather than the lip 8*b*. The cup 15 can hold comestibles, such as the cherries 21 shown in FIG. 7, or other items such as candies, flowers, etc.

It should be understood that the cup 15 may also be used to cover a container 12 placed within the circular opening to the hollow cavity portion of display device 1*a* remaining after removal of the panel 7. For example, after removal of the panel 7 and the lip 8*c*, the lip 13 of container 12 may engage the lip 8*b*, as shown in FIG. 7, and rim 16 of cover member 15, having a diameter greater than that of the lip 8*b*, would engage the lip 8*a*.

It is not necessary that the container which is inserted in the opening remaining after the panel 7 has been removed have a rim which engages a lip 8*a*, 8*b* or 8*c*. Thus, if the container has an upper diameter greater than the diameter of the opening and a lower diameter smaller than the diameter of the opening, the container will frictionally engage the remaining lip and will be supported by such remaining lip.

For example, FIG. 8 shows a decorative container 22 in the form of a basket and without a rim inserted in the opening remaining after the panel 7 and the lips 8c and 8b have been removed. The outer surface of the container 22 frictionally engages the remaining radially inward portion 23 of the lip 8*a* and is supported thereby. The cup 15 containing, for example, flowers 24 in sand, dirt or foamed plastic or other items, can be inserted in the container 22. The decorative container 22 at least partially obscures the plastic cup 15.

Although preferred embodiments of the present invention have been described and illustrated, it will be apparent to those skilled in the art that various modifications may be made without departing from the principles of the invention.

What is claimed is:

1. A display device for displaying articles such as comestibles, flowers and similar items, said device comprising a unitary body of a plastic material having a predetermined vertical axis, said body comprising:

a plurality of hollow tier portions, encircling said axis and disposed in vertically spaced relation to each other, each vertically higher tier portion having a diameter smaller than the diameter of the next adjacent tier portion vertically therebelow and each of said tier portions having an external horizontal portion which substantially continuously encircles said axis and which in a cross-sectional plane parallel to and intersecting said vertical axis, is downwardly concave and at its radially outward edge being connected to said next adjacent tier portion by a lip which is vertically higher than the vertically lowest portion of the tier portion to retain articles placed on the external horizontal portion, and the radially innermost portion of at least one of said tier portions being spaced from said axis.

2. A display device as set forth in claim 1, further comprising a detachable handle means engaging a portion of the vertically highest tier portion for lifting the entire device and detachable from the vertically highest tier portion.

3. A display device as set forth in claim 1, wherein said body has a thickness from about 0.040 to 0.090 inches.

4. A display device as set forth in claim 1, wherein said unitary body is vacuum formed.

5. A display device as set forth in claim 1, wherein said unitary body is made of a material selected from the group consisting of polyethylene terephthalate, polyvinylchloride and high density polyethylene.

6. A display device for displaying articles such as comestibles, flowers and similar items, said device comprising a unitary body of a plastic material having a predetermined vertical axis, said body comprising:

a plurality of tier portions, encircling said axis and disposed in vertically spaced relation to each other, each vertically higher tier portion having a diameter smaller than the diameter of the next adjacent tier portion vertically therebelow and each of said tier portions, in a cross-sectional plane parallel to and intersecting said vertical axis, being downwardly concave and at its radially outward edge being connected to said next adjacent tier portion by a lip which is vertically higher than the vertically lowest portion of the tier portion to retain articles placed on the tier portion, the radially innermost portion of at least one of said tier portions being spaced from said axis; and the radially innermost portion of the vertically highest tier portion being spaced from said axis and said vertically highest tier portion comprising a rupturable panel extending substantially perpendicularly to said vertical axis and connected at its radially outward edge to the radially inner portion of said vertically highest tier portion.

7. A display device as set forth in claim 6, wherein said body includes a line of weakening along the periphery of said panel for rupturing said panel and removing it from said body.

8. A display device as set forth in claim 7, wherein said line of weakening comprises a plurality of spaced slots extending through said body.

9. A display device as set forth in claim 7, wherein said line of weakening comprises a thinning of the body material.

10. A display device as set forth in claim 7, wherein said line of weakening comprises a scoring of the body material.

11. A display device as set forth in claim 7, wherein upon removal of said panel from said body, a support lip is formed along the periphery of the opening formed by said removed panel.

12. A display device as set forth in claim 6, wherein said panel is connected to said radially innermost portion of said vertically highest tier portion by a wall extending around the periphery of said panel, said wall having a plurality of spaced slots extending therethrough.

13. A display device for displaying articles such as comestibles, flowers and similar items, said device comprising a unitary body of a plastic material having a predetermined vertical axis, said body comprising:

a plurality of hollow tier portions, encircling said axis and disposed in vertically spaced relation to each other, each vertically higher tier portion having a diameter smaller than the diameter of the next adjacent tier portion vertically therebelow and each of said tier portions having an external horizontal portion which substantially continuously encircles said axis and which in a cross-sectional plane parallel to and intersecting said vertical axis, being downwardly concave and at its radially outward edge is connected to said next adjacent tier portion by a lip which is vertically higher than the vertically lowest portion of the tier portion to retain articles placed on the external horizontal portion, and the radially innermost portion of at least one of said tier portions being spaced from said axis; and an uppermost top portion having a diameter smaller than the diameter of the tier portion vertically therebelow and connected thereto, and comprising at least two lips spaced from said axis, each adjacent pair of lips having a groove therebetween.

14. A display device as set forth in claim 13, wherein said top portion further comprises a rupturable panel extending substantially perpendicularly to said vertical axis and connected at its radially outward edge to the radially innermost lip.

15. A display device as set forth in claim 14, wherein said body includes a line of weakening along the periphery of said panel for rupturing said panel and removing it from said body.

16. A display device as set forth in claim 13, wherein at least one of said grooves between said lips includes a line of weakening along said groove for rupturing a radially inward portion of said top portion and removing it from said body.

17. A display device as set forth in claims 15 or 16, wherein said line of weakening comprises a plurality of spaced slots extending through said body.

18. A display device as set forth in claims 15 or 16, wherein said line of weakening comprises a thinning of the body material.

19. A display device as set forth in claims 15 or 16, wherein said line of weakening comprises a scoring of the body material.

20. A display device as set forth in claim 15, wherein upon removal of said panel from said body, a support lip is formed along the periphery of the opening formed by said removed panel.

21. A display device as set forth in claim 16, wherein upon removal of said radially inward portion from said body, a support lip is formed along the periphery of the opening formed by said removed radially inward portion.

22. A display device as set forth in claim 13, wherein said at least two lips encircle said axis and are disposed in a vertically spaced relation to each other, each vertically higher lip having a diameter smaller than the diameter of the next adjacent lip vertically therebelow and connected thereto.

23. A display device as set forth in claim 13, further comprising a detachable handle means engaging a portion of the vertically highest tier portion for lifting the entire device and detachable from the vertically highest tier portion.

24. A display device as set forth in claim 13, wherein said body has a thickness from about 0.040 to 0.090 inches.

25. A display device as set forth in claim 13, wherein said unitary body is vacuum formed.

26. A display device as set forth in claim 13, wherein said unitary body is made of a material selected from the group consisting of polyethylene terephthalate, polyvinylchloride and high density polyethylene.

* * * * *